United States Patent [19]

Martinez, Jr.

[11] Patent Number: 4,817,395

[45] Date of Patent: Apr. 4, 1989

[54] METHOD AND APPARATUS FOR SAVING ENERGY IN AN AIR CONDITIONING SYSTEM

[76] Inventor: George Martinez, Jr., P.O. Box 1141, Gonzales, La. 70737

[21] Appl. No.: 60,535

[22] Filed: Jun. 11, 1987

[51] Int. Cl.[4] ..... F25D 17/02

[52] U.S. Cl. ..... 62/175; 62/180; 62/201

[58] Field of Search ..... 62/175, 185, 201, 180; 236/91 F; 237/8 R; 165/40

[56] References Cited

U.S. PATENT DOCUMENTS 2,349,671 5/1944 Newton ..... 62/185

3,144,991 8/1964 Marchant ..... 236/91 F X 3,859,812 1/1975 Pavlak ..... 62/201

*Primary Examiner*—William E. Wayner

*Attorney, Agent, or Firm*—David L. Ray

[57] ABSTRACT

A method and apparatus for conserving energy in the operation of a conventional air conditioning system in a large building employing a condenser, an evaporator, a chilled water circuit, and a refrigerant compressor or heat source in an absorption-type air conditioner wherein the chilled water flow is modulated to match the actual cooling load needed in the building, and when utilized in an air conditioning system having multiple air conditioning units one or more of the air conditioning units is turned off along with associated pumps and valves.

13 Claims, 3 Drawing Sheets

METHOD AND APPARATUS FOR SAVING ENERGY IN AN AIR CONDITIONING SYSTEM

BACKGROUND OF THE INVENTION

1. Field of the Invention

The present invention relates to a refrigeration and air conditioning system. In particular, the invention relates to a method and apparatus for saving energy in the operation of a large building employing chilled water air conditioning systems.

2. Description of the Related Art

Both compression and absorption systems are used in chilled water air conditioning systems to cool large buildings. These two air conditioning systems generally use the same design of condenser and evaporator. See the Standard Handbook for Mechanical Engineers, Seventh Edition, Theodore Baumeister, Editor, McGraw-Hill Book Company, New York, N.Y. page 18–12, which is hereby incorporated by reference.

In large buildings, air conditioning systems are designed to promote year-round cooling. This characteristic is essential to a cooling system designed for buildings in which the outer peripheral surfaces and areas are subject to wide temperature gradients while the inner portions remain relatively stable regardless of the ambient conditions.

Such an air conditioning system must, in general, be operated during substantially the entire year to provide the necessary cooling and air circulation. In the winter, the rooms on the outer periphery of the building must be heated and the interior rooms having no external exposure must be cooled. In the summer, the entire building must be cooled.

An air conditioning system utilizing chilled water as the cooling medium circulating between the refrigeration units (chillers) and the rooms or other areas in the building to be cooled is designed with sufficient capacity to cool the building while fully occupied to a comfortable temperature when the ambient air outside the building reaches a preselected maximum temperature. Thus, a chilled water air conditioning system has an excess of cooling capacity even when the building is fully occupied except on days when the outside conditions are at or above the maximum design conditions. Also, as known to those skilled in the art, it is common for a building to have sufficient air conditioning capacity to exceed maximum design conditions. In general, the only time maximum design conditions will be encountered is when the chilled water air conditioning system is restarted after problems have caused the air conditioning system to be shut down on a hot day for a period of time sufficient for the temperature of the interior of the building to rise close to ambient temperatures outside the building.

Most chilled water air conditioning systems are designed to produce a constant flow (gallons per minute) of chilled water. When multiple chillers are employed, and maximum capacity is not required, one or both chillers are commonly operated at less than full capacity. As is known to those skilled in the art, the efficiency of most chillers operating at less than full capacity is reduced, and the energy consumed per ton of cooling is increased.

SUMMARY OF THE INVENTION

It is an object of the present invention to cool a building having multiple chillers when ambient conditions permit with less energy by turning one or more of the multiple chillers off. Energy savings can be achieved if one or more compressor or compressors can be turned off and the remaining compressor or compressors be operated at full load.

It is another object of the present invention to save energy in the operation of a building with a chilled water system by varying the total water flow through a chiller to operate the chiller more efficiently when the maximum cooling capacity of a chiller is not required to cool the building to a comfortable temperature.

In accordance with the present invention there is provided a method and apparatus for saving energy in the operation of a conventional air conditioning system employing chilled water and multiple chillers for cooling the chilled water by turning off one or more chillers when the cooling capacity of the turned off chillers is not needed to cool the building, and blocking off all water flow to the chiller or chillers which has been turned off. When multiple chillers are employed and one or more chillers is turned off or cycled off, the return and supply chilled water would be normally blended by continuing to circulate water through the one or more chillers which had been cycled off or turned off. In the present invention, the appropriate valves are closed to stop water flow through the chiller or chillers which have been cycled off or turned off causing the remaining chiller or chillers to use less energy while still providing chilled water at the desired temperatures.

In accordance with the present invention there is also provided a method and apparatus for saving energy in the operation of a conventional air conditioning system in a large building employing chilled water circuits wherein the chilled water flow is varied in accordance with the amount of cooling necessary in the building. When the chilled water flow is reduced, the amount of chilled water circulated by the chilled water pump or pumps is reduced causing the chilled water pump or pumps to use less energy. Also, the cooling load on the compressor or compressors is increased allowing it to operate more efficiently. Also, the heat of compression or heat of absorption is reduced causing the condenser or cooling tower to work less and use less energy.

DESCRIPTION OF THE PREFERRED EMBODIMENTS

Figure 1:
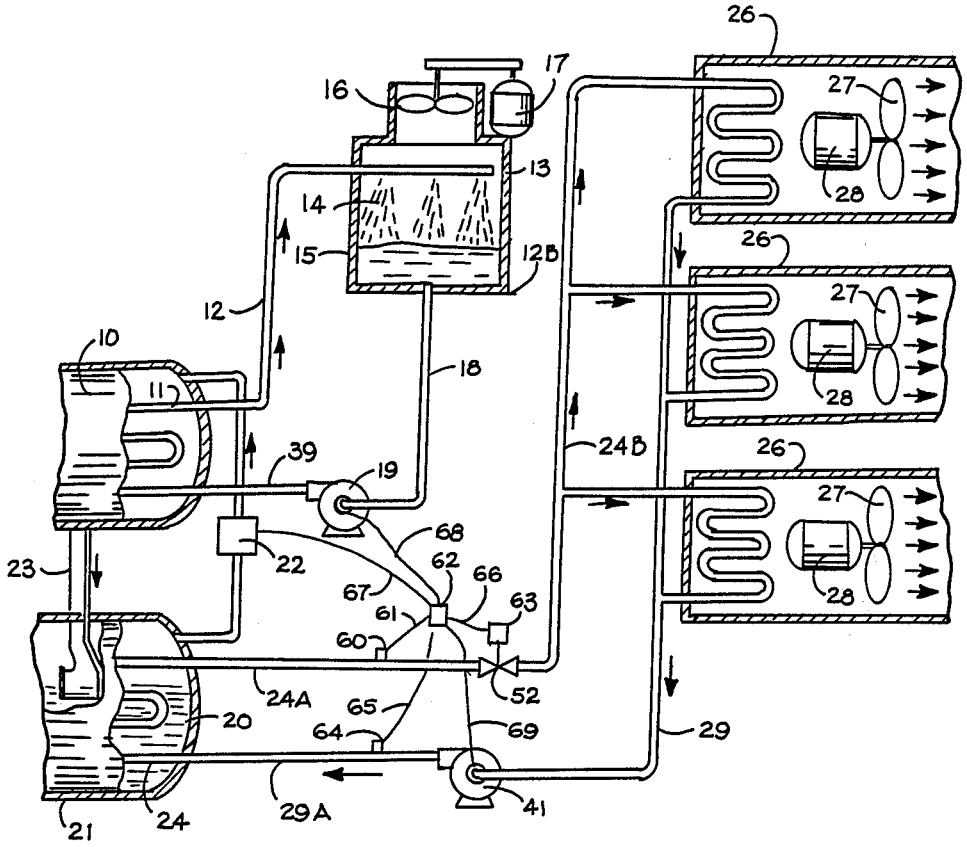
FIG. 1 is a schematic drawing of the present invention for varying the total water flow through an air conditioning unit.

The method and apparatus for varying the total water flow through an air conditioning unit (sometimes referred to herein as a chiller) to operate the chiller more efficiently when the maximum cooling capacity of a chiller is not required to cool the building to a comfortable temperature is shown in FIG. 1. Referring now to FIG. 1, the numeral 10 designates a condenser of the usual building air conditioning unit which has a bundle of water tubes 11 running therethrough and which has an outlet pipe 12 running to the upper end of the cooling tower 13. The outlet pipe terminates in a series of holes along its bottom edge which form a downward spray 14 in the cooling tower. The cooling tower 13 is a typical cooling tower which has air intake louvers (not shown) in the walls 15 and a suction fan 16 which is operated by motor 17 which draws air upwardly through the spray 14 and out to the open air. Water flows from basis of cooling tower 13 through pipe 18 to pump 19, and into condenser 10 through pipe 39 thereby completing the cycle. Other cooling towers such as ejector types employing no fan, or natural draft types employing no fan may be utilized in place of cooling tower 13 is desired. An air cooled condenser may be utilized.

Thus, the water, brine, or other liquid in water tubes 11 in condenser 10 is constantly cooled by the cooling tower so as to cool and liquify the vapors of refrigerant 20 passing into condenser 10 from evaporator 21 through a compressor 22 of conventional structure connecting one end of evaporator 21 to the adjoining end of condenser 10. The compressor 22 is of usual and conventional construction and is not shown in detail.

The evaporator 21 is also connected to condenser 10 by a float trap or expansion valve 23 of usual and conventional construction through which the refrigerant 20 can pass in only one direction from condenser 10 into the evaporator 21. A bundle of chilled water tubes 24 are mounted in the lower half of evaporator 21 so as to run its entire length. The chilled water tubes 24 are covered by refrigerant 20.

The tubes carrying the chilled water or brine leave the evaporator 21 through pipe 24a as indicated by the arrow when valve 52 is open, as it would during normal operation. The chilled water or brine leaving evaporator 21 through pipe 21 is sometimes referred to herein as supply chilled water. The chilled water then passes through valve 52 into pipe 24*b* and passes in parallel through room cooling units 26 equipped with fans 27 driven by motors 28 in the direction indicated by the arrows. The chilled water is then returned by pipe 29 through pump 41 into pipe 29*a* and evaporator 21, thereby completing the cycle. The chilled water being returned by pipe 29*a* to evaporator 21 is sometimes referred to herein as return chilled water.

In normal operation, in order to secure chilling of the water circulated from the evaporator 21 through pipes 24*a*, 24*b*, cooling units 26, and pipes 29 and 29*a*, it is necessary to run compressor 22 to build up pressure and condense the refrigerant vapors from the evaporator 21 to liquify the vapors. The liquified refrigerant 20 is then returned through float trap 23 to the evaporator 21. During this cycle valve 52 is open, and the system is operating as a conventional air conditioning system.

The apparatus of the present invention includes, in addition to the normal or conventional building air conditioning system and its conventional components, valve 52 which is controlled by a motor, and pneumatic or electrical control 63, to vary the chilled water flow to the cooling units in response to the differential between the temperature of the return chilled water and the supply chilled water.

Valve 52 is fully open when the air conditioning system including evaporator 21 is first turned on and the building temperature is higher than desired. Evaporator 21 is a conventional evaporator designed to provide chilled water to pipe 24*a* at a preselected temperature, typically 45° Fahrenheit (hereinafter Fahrenheit is abbreviated as "F"). Temperature gauge 60 measures the temperature of the supply chilled water in pipe 24*a* and transmits the temperature measurement through line 61 to comparator 62. Temperature gauge 64 measures the temperature of the return chilled water in pipe 29*a* and transmits the temperature measurement through line 65 to comparator 62. Comparator 62 can be any conventional component such as a microprocessor for comparing the temperature measurements received through lines 61 and 65, and transmitting a control signal through line 66 to control 63 to open, close or partially close valve 52 to control the flow (volume per unit of time) of chilled water through the valve 52. Valve 52 may be located at any point in the supply or return chilled water lines 24*a*, 24*b*, 29 or 29*a*.

Comparator 62 is programmed to send a signal through line 66 to control 63 to partially close valve 52 when the difference in the temperature of the supply chilled water and return chilled water is less than a pre-selected temperature programmed in comparator 62. For example, the comparator may be programmed to partially close valve 52 by a pre-selected amount when the difference between the supply chilled water and return chilled water is 9° F. or less. Thus, when the supply chilled water is 45° F. and return chilled water is 54° F., the difference is 9° F., and valve 52 would be partially closed to restrict chilled water flow therethrough by a desired percentage, for example, twenty percent. If the difference between the supply chilled water and the return chilled water decreases to 8° F., the comparator 62 can be programmed to send a signal to control 63 to close valve 52 by a desired additional percentage for example, forty percent restriction of chilled water flow through valve 52.

When the valve 52 is closed by a preset amount, for example, fifty percent, the chiller continues to run until the conventional temperature controls automatically turns the chiller off.

Figure 2:
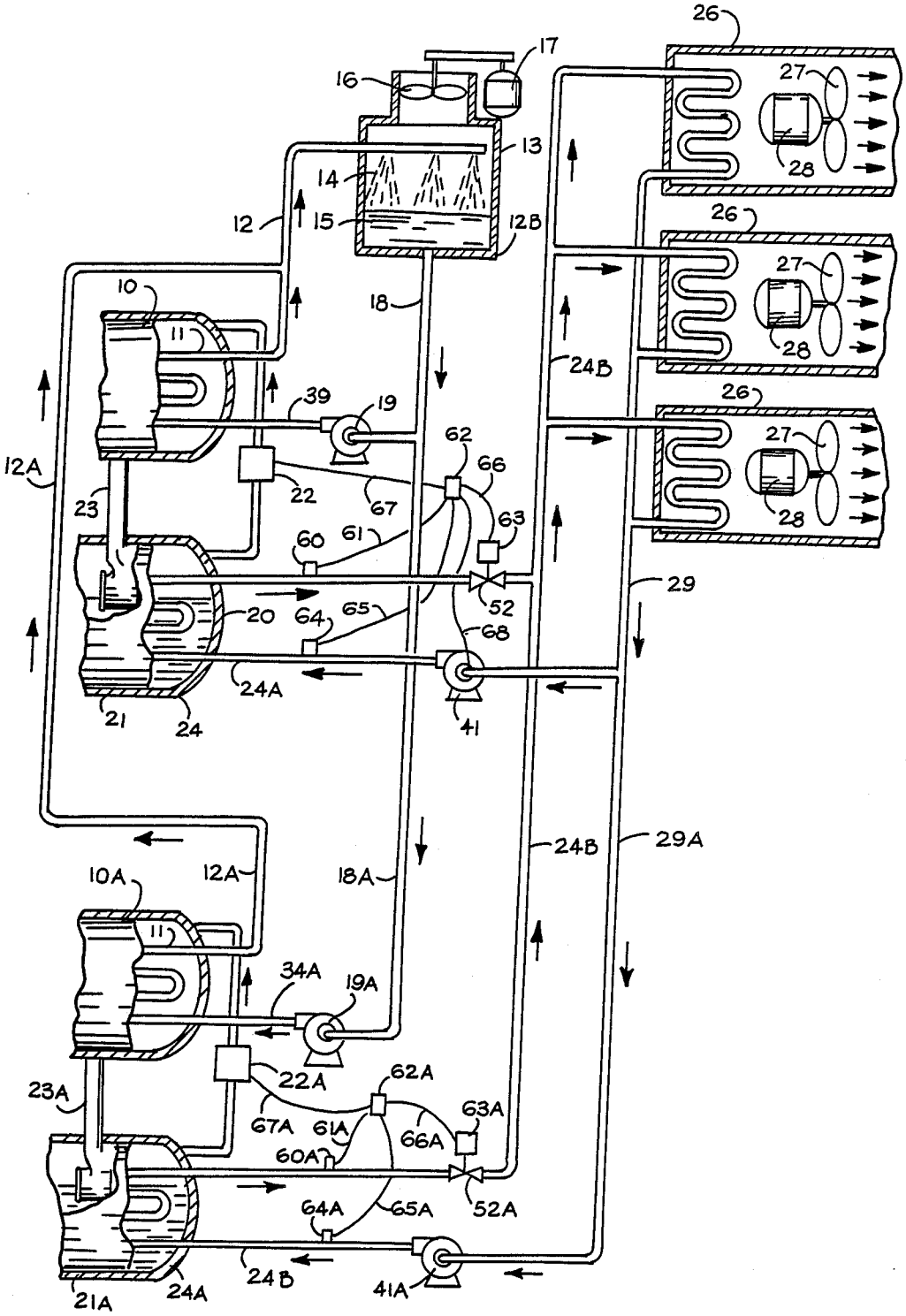
FIG. 2 is a schematic drawing of second embodiment of the invention for turning off one or more multiple air conditioning units not needed to cool a building.

Referring now to FIG. 2 there is shown another embodiment of the invention wherein two air conditioning units are connected parallel. The numerals 10 and 10*a* designate condensers of the usual building air conditioning unit which has a bundle of water tubes 11 and 11*a* running therethrough and which have outlet pipes 12 and 12*a* running to the upper end of the cooling tower 13. The outlet pipe terminates in a series of holes along its bottom edge which form a downward spray 14 in the cooling tower. The cooling tower 13 is a typical cooling tower which has air intake louvers (not shown) in the walls 15, and a suction fan 16 operated by motor 17 which draws air upwardly through the spray 14 and out to the open air. Water flows from the basin of cooling tower 13 through pipe 18 to pumps 19, through pipe 18*a* to pump 19*a*, and through pipes 39 and 39*a* thereby completing the cycle. Other cooling towers such as ejector types employing no fan, or natural draft types employing no fan may be utilized in place of cooling tower 13 if desired, or an air cooled condenser may be utilized.

Thus, the water, brine, or other liquid in water tubes 11 and 11*a* in condensers 10 and 10*a* is constantly cooled by the cooling tower so as to cool and liquify the vapors of refrigerant 20 and 20*a* passing into condensers 10 and 10*a* from evaporators 21 and 21*a* through compressors 22 and 22*a* of conventional structure connecting the ends of evaporators 21 and 21*a* to the adjoining ends of condensers and 10 and 10*a*. Compressors 22 and 22*a* are of usual and conventional construction and are not shown in detail.

The evaporators 21 and 21*a* are also connected to condensers 10 and 10*a* by a float traps or expansion valves 23 and 23*a* of usual and conventional construction through which refrigerant 20 and 20*a* can pass in only one direction from condensers 10 and 10*a* into evaporators 21 and 21*a*. A bundle of chilled water tubes 24 and 24*a* are mounted in the lower half of evaporators 21 and 21*a* so as to run its entire length. The chilled water tubes 24 and 24*a* are covered by refrigerant 20 and 20*a*.

The tubes carrying the chilled water or brine leave the evaporators 21 and 21*a* through pipes 24 and 24*a* as indicated by the arrows when valves 52 and 52*a* are open, as it would during normal operation. The chilled water then passes through valves 52 and 52*a* into pipe 24*b* and passes in parallel through room cooling units 26 equipped with fans 27 driven by motors 28 in the direction indicated by the arrows. The chilled water is then returned by pipes 29 through pumps 41 and 41*a* into pipes 29*a* and 29*b* and evaporators 21 and 21*a*, thereby completing the cycle.

In normal operation, in order to secure chilling of the water circulated from the evaporators 21 and 21*a* through 24, 24*a*, 24*b*, cooling units 26, and pipes 29, 29*a* and 29*b*, it is necessary to run compressors 22 and 22*a* to build up pressure and condense the refrigerant vapors from the evaporators 21 and 21*a* to liquify the vapors. The liquified refrigerant 20 and 20*a* is then returned through float traps 23 and 23*a* to the evaporators 21 and 21*a*. During this cycle, valves 52 and 52*a* are open, and the system is operating as a conventional air conditioning system for a building.

The apparatus and method of the present invention turns off one air conditioning unit when two units are not needed. The unit to be turned off is referred to as the lag chiller and the unit to be left on is referred to as the lead chiller. For purposes of illustration, the chiller utilizing compressor 22 will be the lag chiller.

To determine when compressor 22 and pumps 19 and 41 should be turned off, return chilled water temperature in pipe 29*a* is measured by temperature gauge 64 and the measurement is transmitted through line 65 to comparator 62 which compares the temperature of the return chilled water to a programmed pre-set temperature which corresponds to the temperature the return chilled water reaches when only one of the two compressors 22 and 22*a* is needed to cool the building. When the return chilled water temperature is equal to the programmed pre-set temperature, comparator 62 turns off compressor 22 through line 67, turns off pump 41 through line 68, and closes valve 52. Thus no water can flow through evaporator 21 and only compressor 21a, pumps 19*a* and 41*a* are operating. Comparator 62 may be any conventional component such as a microprosser for comparing the temperature measurements received through line 65 to a pre-set or programmed temperature.

Figure 3:
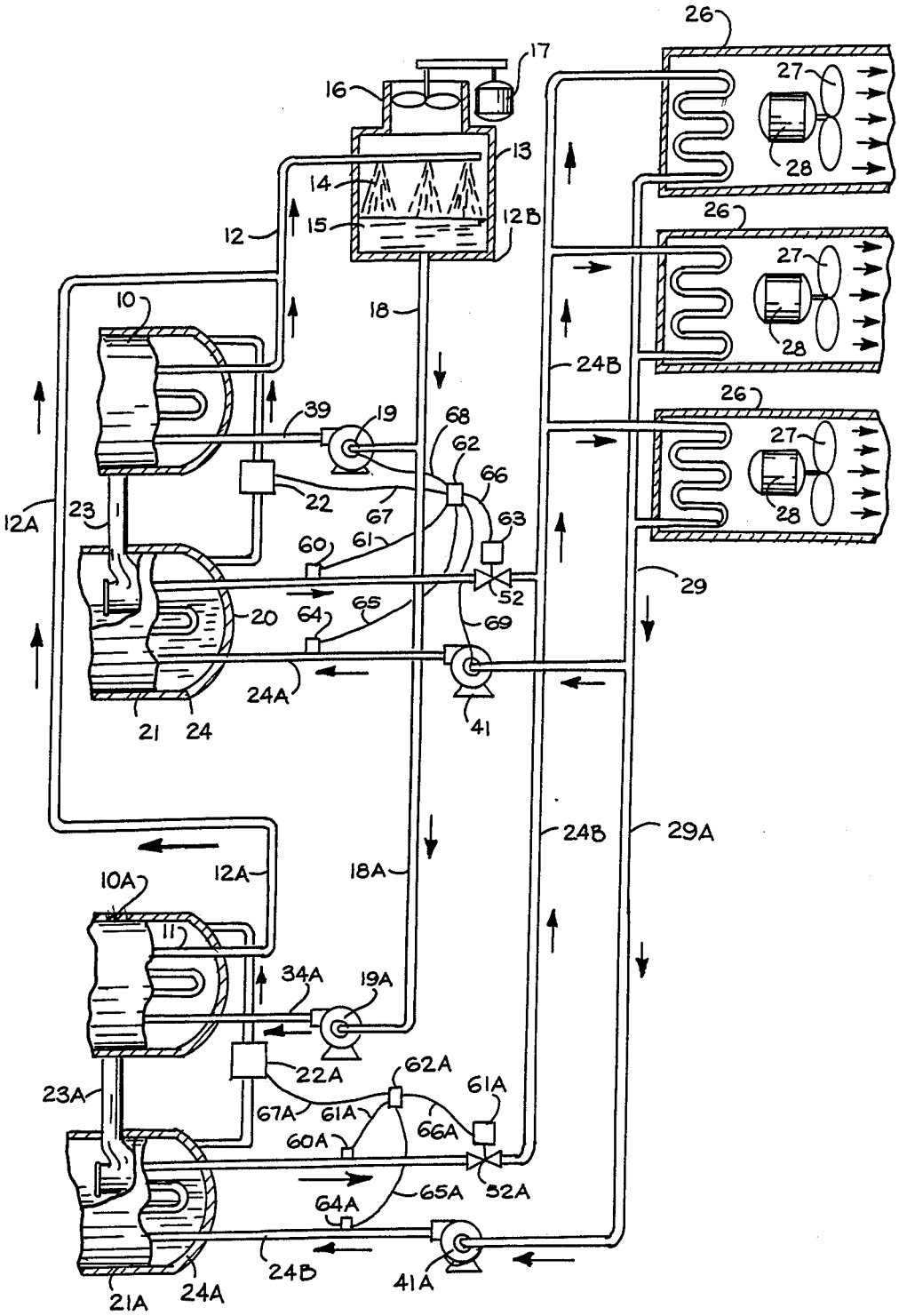
FIG. 3 is a schematic drawing of a third embodiment of the invention for varying the total water flow through air conditioning unit in a building employing multiple air conditioning units and turning one or more of the multiple air conditioning units off when one or more of the multiple air conditioning units is not needed to cool a building.

Referring now to FIG. 3 there is shown another embodiment of the invention wherein two air conditioners units are connected parallel. FIG. 3 is identical to FIG. 2 except that additional temperature gauge 60 is connected to pipe 24 to measure the temperature of the supply chilled water in pipe 24, additional line 61 is connected to temperature gauge 60 and comparator 62.

The numerals 10 and 10*a* designate condensers of the usual building air conditioning unit which has a bundle of water tubes 11 and 11*a* running therethrough and which have outlet pipes 12 and 12*a* running to the upper end of the cooling tower 13. The outlet pipe terminates in a series of holes along its bottom edge which forms a downward spray 14 in the cooling tower. The cooling tower 13 is a typical cooling tower which has air intake louvers (not shown) in the walls 15, and a suction fan 16 operated by motor 17 which draws air upwardly through the spray 14 and out to the open air. Water flows from the basis of cooling tower 13 through pipe 18 to pumps 19, through pipe 18*a* to pump 19*a*, and through pipes 39 and 39*a* thereby completing the cycle. Other cooling towers such as ejector types employing no fan, or natural draft types employing no fan may be utilized in place of cooling tower 13 is desired, or an air cooled condenser may be utilized.

Thus, the water, brine, or other liquid in water tubes 11 and 11*a* in condensers 10 and 10*a* is constantly cooled by the cooling tower so as to cool and liquify the vapors of refrigerant 20 and 20*a* passing into condensers 10 and 10*a* from evaporators 21 and 21*a* through compressors 22 and 22*a* of conventional structure connecting the ends of evaporators 21 and 21*a* to the adjoining ends of condensers and 10 and 10*a*. Compressors 22 and 22*a* are of usual and conventional construction and are not shown in detail.

The evaporators 21 and 21*a* are also connected to condensers 10 and 10*a* by a float traps or expansion valves 23 and 23*a* of usual and conventional construction through which refrigerant 20 and 20*a* can pass in only one direction from condensers 10 and 10*a* into evaporators 21 and 21*a*. A bundle of chilled water tubes 24 and 24*a* are mounted in the lower half of evaporators 21 and 21*a* so as to run its entire length. The chilled water tubes 24 and 24*a* are covered by refrigerant 20 and 20*a*.

The tubes carrying the chilled water or brine leave the evaporators 21 and 21*a* through pipes 24 and 24*a* as indicated by the arrows when valves 52 and 52*a* are open, as they would be during normal operation. The chilled water then passes through valve 52 and 52*a* into pipe 24*b* and passes in parallel through room cooling units 26 equipped with fans 27 driven by motors 28 in the direction indicated by the arrows. The chilled water is then returned by pipes 29 through pumps 41 and 41*a* into pipes 29*a* and 29*b* and evaporators 21 and 21*a*, thereby completing the cycle.

In normal operation, in order to secure chilling of the water circulated from the evaporators 21 and 21*a* through 24, 24*a*, 24*b*, cooling units 26, and pipes 29, 29*a* and 29*b*, it is necessary to run compressors 22 and 22*a* to build up pressure and condense the refrigerant vapors from the evaporators 21 and 21*a* to liquify the vapors. The liquified refrigerant 20 and 20*a* is then returned through float traps 23 and 23*a* to the evaporators 21 and 21*a*. During this cycle, valves 52 and 52*a* are open, and the system is operating as a conventional air conditioning system for a building.

The apparatus and method of the present invention varies the flow from one of the chillers in response to the differential between the temperature of the return chilled water and the supply chilled water and turns off one or more air conditioning unit(s) when not needed to cool a building. The unit through which the water flow is to be varied or turned off is referred to as the lag chiller and the unit to be left on is referred to as the lead chiller. For purposes of illustration, the chiller utilizing compressor 22 will be the lag chiller.

Valve 52 is fully open when the air conditioning system including evaporator 21 is first turned on and the building temperature is higher than desired. Evaporator 21 is a conventional evaporator designed to provide chilled water to pipe 24 at a preselected temperature, typically 45° Fahrenheit (hereinafter Fahrenheit is abbreviated as "F"). Temperature gauge 60 measures the temperature of the supply chilled water in pipe 24 and transmits the temperature measurement through line 61 to comparator 62. Temperature gauge 64 measures the temperature of the return chilled water in pipe 29a and transmits the temperature measurement through line 65 to comparator 62. Comparator 62 can be any conventional component such as a microprocessor for comparing the temperature measurements received through lines 61 and 65, and transmitting a control signal through line 66 to control 63 to open, close or partially close valve 52 to control the flow (volume per unit of time) of chilled water through valve 52. Valve 52 may be located at any point in the supply or return chilled water lines 24*a*, 24*b*, 29 or 29*a*.

Comparator 62 is programmed to send a signal through line 66 to control 63 to partially close valve 52 when the difference in the temperature of the supply chilled water and return chilled water is less than a pre-selected temperature programmed in comparator 62. For example, the comparator may be programmed to partially close valve 52 by a pre-selected amount when the difference between the supply chilled water and return chilled water is 9° F. or less. Thus, when the supply chilled water is 45° F. and return chilled water is 54° F., the difference is 9° F., and valve 52 would be partially closed to restrict chilled water flow therethrough by a desired percentage, for example, twenty percent. If the difference between the supply chilled water and the return chilled water decreases to 8° F., the comparator 62 can be programmed to send a signal to control 63 to close valve 52 by a desired additional percentage, for example, forty percent restriction of chilled water flow through valve 52. Valve 52*a* remains fully open.

To determine when compressor 22 and pumps 19 and 41 should be completely cycled off or turned off, return chilled water temperature in pipe 29*a* is measured by temperature gauge 64 and the measurement is transmitted through line 65 to comparator 62 which compares the temperature of the return chilled water to a programmed pre-set temperature which corresponds to the temperature the return chilled water reaches when only one of the two compressors 22 and 22*a* is needed to cool the building. When the return chilled water temperature is equal to the programmed pre-set temperature, comparator 62 turns off compressor 22 through line 67, turns off pump 41 through line 68, and closes valve 52. Thus no water can flow through evaporator 21 and only compressor 21*a*, pumps 19*a* and 41*a* are operating.

When only the lead chiller remains in operation, and the supply chilled water valve 52*a* is closed by a predetermined amount, for example fifty percent, the chiller continues to run until the conventional temperature controls automatically turns the chiller off. Normally, when multiple chillers are used, at least one chiller is needed at all times.

Thus, the embodiment shown in FIG. 3 allows the lead chiller to operate at full capacity while the chilled water flow through the lag chiller is reduced. Such operation is desired when the building requires more cooling capacity than one chiller can supply but less cooling capacity than both chillers can supply, while maintaining the temperature differential between the supply chilled water and the return chilled water in the range required for efficient operation of both chillers.

The same procedure and apparatus used in the embodiment shown in FIG. 3 could be used when three or more parallel chillers are used. A lag chiller would be selected and the chilled water flow would be reduced therein to maintain optimum temperature differential between the supply chilled water and the return chilled water. As the cooling capacity needed to cool the building continues to decrease, the lag chiller would be shut off, and one of the remaining chillers would be selected as a lag chiller until the capacity of the operating chillers equals the cooling capacity needed to cool the building.

As is known to those skilled in the art, some air conditioning systems substitute a nozzle arrangement for the float assembly 23 whereby refrigerant is injected into a circuit of tubes in the evaporator, rather than injecting the refrigerant into the body of the evaporator shell. Vaporous refrigerant is removed from the tubes in the evaporator by the compressor 22. The chill water is in turn injected into the body of the evaporator shell. The present invention is applicable to such a nozzle arrangement as would be obvious to those skilled in the art.

Also, as is known to those skilled in the art, rather than using a shell and tube arrangement, a tube-in-tube or a plate frame heat exchanger or any other conventional heat exchanger arrangement can be utilized to effect heat transfer between the refrigerant and the water circuit. The present invention is applicable to such a tube-in-tube arrangement or plate frame heat exchanger as would be obvious to those skilled in the art.

It will be understood that any recognized source of cold water, or any other conventional cooling source, may be used instead of the cooling tower 13 such as cold well water as is generally used in installations where it is available. A cold well water source will increase the heat transfer rate between the refrigerant 20 and the chill water and tube bundle 24 sufficiently to obtain the required temperature of the chilled water.

Both embodiments of the invention would be applicable to a compression-type air conditioning system as shown in the drawings, or to an absorption-type air conditioning system (not shown) as is obvious to those skilled in the art. Replacement of the compressor 22 with a pump, an absorber, and thermally activated arrangement (heat source) such as the system disclosed on page 18–12 of the Standard Handbook for Mechanical Engineers would not alter the operation or apparatus of the invention. A pump is used in the absorption system to circulate refrigerant between the evaporator and the condenser.

It is believed that the invention and many of its attendant advantages will be understood from the foregoing description and it will be apparent that various changes may be made in the form, construction, and arrangement of the parts without departing from the spirit and scope of the invention. The form hereinbefore described are merely preferred embodiments of the invention.

What is claimed is:

1. A method for reducing the amount of energy consumed in cooling a building with a chilled water air conditioning system having an evaporator containing a supply chilled water line and a return chilled water line comprising:

a. operating the air conditioning system at full capacity until the supply chilled water temperature reaches a pre-set temperature, and b. varying the total water flow in the return chilled water line and the supply chilled water line to maintain the temperature differential between the temperature of the water in the supply chilled water line and the temperature of the water in the return chilled water line at a pre-set value.

2. The method of claim 1 wherein said total water flow is varied by partially closing a valve.

3. The method of claim 2 wherein said valve is located in said supply chilled water line.

4. The method of claim 2 wherein said valve is located in said return chilled water line.

5. The method of claim 1 wherein said temperature differential is determined by measuring the temperature of chilled water in said supply chilled water line and measuring the temperature of chilled water in said return chilled water line, and comparing said two measured temperatures to determine the difference therebetween.

6. The method of claim 1 wherein chilled water is circulated through said supply chilled water line and said return chilled water line by pump means.

7. An apparatus for controlling the amount of energy consumed in cooling a building with a chilled water air conditioning system having an evaporator containing a supply chilled water line and a return chilled water line comprising:

a. means for measuring the temperature of supply chilled water, b. means for measuring the temperature of return chilled water, c. means for comparing the temperature of said supply chilled water and said return chilled water to determine the temperature differential between said supply chilled water and said return chilled water, and d. means for varying the total flow of water in said chilled water loop to maintain a pre-set temperature differential between said return chilled water and said supply chilled water.

8. The apparatus of claim 7 wherein said means for comparing the temperature comprises a microprocessor.

9. The apparatus of claim 7 wherein said means for varying the total flow of water comprises valve means.

10. The apparatus of claim 9 wherein said valve means is partially closed and opened by control means.

11. The apparatus of claim 9 wherein said control means is connected to and actuated by said means for comparing the temperature of said return chilled water and said supply chilled water.

12. The apparatus of claim 11 wherein said means for comparing the temperature of said return chilled water and said supply chilled water is connected to, and receives temperature measurements from, said means for measuring the temperature of said supply chilled water and said means for measuring the temperature of said return chilled water.

13. The apparatus of claim 7 wherein pump means is connected to said return chilled water line for pumping water through said return chilled water line.

* * * * *